US011111096B2

(12) United States Patent
Fujishima

(10) Patent No.: US 11,111,096 B2
(45) Date of Patent: Sep. 7, 2021

(54) SHEET POSTPROCESSING APPARATUS AND IMAGE FORMING SYSTEM

(71) Applicant: Konica Minolta, Inc., Tokyo (JP)

(72) Inventor: Tatsumi Fujishima, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 161 days.

(21) Appl. No.: 16/529,399

(22) Filed: Aug. 1, 2019

(65) Prior Publication Data

US 2020/0071114 A1 Mar. 5, 2020

(30) Foreign Application Priority Data

Aug. 31, 2018 (JP) ..... JP2018-163021

(51) Int. Cl.
*B65H 29/22* (2006.01)
*B65H 31/36* (2006.01)

(52) U.S. Cl.
CPC ..... *B65H 29/22* (2013.01); *B65H 31/36* (2013.01); *B65H 2301/4223* (2013.01); *B65H 2801/27* (2013.01)

(58) Field of Classification Search
CPC B65H 29/22; B65H 31/36; B65H 2301/4223; B65H 2801/27
USPC ..... 270/58.12, 58.17; 271/184
See application file for complete search history.

(56) References Cited

U.S. PATENT DOCUMENTS 6,145,825 A * 11/2000 Kunihiro ..... B42C 1/12 270/58.09
6,412,774 B1 * 7/2002 Saito ..... B42C 1/12 271/220
7,475,874 B2 * 1/2009 Sato ..... B65H 29/001 270/58.09
7,537,206 B2 * 5/2009 Tokuno ..... B42C 1/12 270/58.07
10,479,636 B2 * 11/2019 Nakano ..... B65H 43/04

FOREIGN PATENT DOCUMENTS

JP 2004284716 A 10/2004
JP 2007223701 A 9/2007

* cited by examiner

*Primary Examiner* — Leslie A Nicholson, III
(74) *Attorney, Agent, or Firm* — Lucas & Mercanti, LLP

(57) ABSTRACT

In a sheet postprocessing apparatus, an accommodation paddle increases a rate of increase in transport force generated for sheets by the accommodation paddle, in conjunction with a rate of increase in transport resistance generated for the sheets by a sheet pressing member with an increase in number of the sheets stacked on a sheet stacker.

5 Claims, 18 Drawing Sheets

SHEET POSTPROCESSING APPARATUS AND IMAGE FORMING SYSTEM

The entire disclosure of Japanese Patent Application No. 2018-163021, filed on Aug. 31, 2018, is incorporated herein by reference in its entirety.

BACKGROUND

Technological Field

The present invention relates to a sheet postprocessing apparatus and an image forming system.

Description of the Related Art

To register a bundle of stacked sheets in a transport direction in a sheet postprocessing apparatus that registers stacked sheets in a transport direction and a direction perpendicular to the transport direction and performs processing such as punching and stapling, there is known a method of transporting a bundle of sheets in a direction in which the bundle is pushed against an end guide by rotation of an accommodation paddle having a flexible member (Japanese Laid-Open Patent Publication Nos. 2004-284716 and 2007-223701).

As the number of stacked sheets increases, a bundle of sheets expands due to the physical properties of the sheets such as curling property of the sheets and rigidity of the sheets, with the risk of coming into contact with a guide member provided above the bundle of sheets. Therefore, various forms of sheet pressing members have been proposed.

SUMMARY

When transporting sheets by rotation of an accommodation paddle, as the number of stacked sheets increases, the accommodation paddle is deflected further, which leads to an increase in area of contact with the sheets and an increase in transport force.

When the number of stacked sheets increases, however, a sheet pressing member provided above an end guide is lifted, causing an increase in pressing force to the sheets by the sheet pressing member. As a result, a frictional force generated between the sheets and the sheet pressing member increases, which leads to an increase in transport resistance, resulting in the sheet transport being hindered.

Usually, a sheet pressing member is not required for a small number of stacked sheets. A sheet pressing member is thus configured to not function until a certain number of sheets or a certain height of stacked sheets is reached, and to function when that certain level is exceeded.

Accordingly, the transport resistance does not increase linearly with respect to the number of stacked sheets or the height of stacked sheets, but increases rapidly when the certain number of sheets or the certain height of stacked sheets is exceeded. On the other hand, the transport force by the accommodation paddle increases substantially linearly.

When the certain number of sheets or the certain height of stacked sheets is exceeded, the difference between the transport force by the accommodation paddle and the transport resistance by the sheet pressing member decreases. As a result, the transport force by the accommodation paddle may be overwhelmed by the transport resistance by the sheet pressing member, resulting in inability to transport the sheets by the accommodation paddle.

The present invention has been made in view of the problem above, and an object of the invention is to provide a sheet postprocessing apparatus and an image forming system configured such that, even when then the number of stacked sheets exceeds a certain height of stacked sheets, the sheets can be transported by an accommodation paddle, without transport force by the accommodation paddle being overwhelmed by transport resistance by a sheet pressing member.

This sheet postprocessing apparatus includes: a processing tray on which sheets are stacked and arranged; a vertical registration member for registering a front edge side and a rear edge side in a transport direction of the sheets stacked and arranged on the processing tray; and a sheet pressing member for pressing the sheets stacked on the processing tray from above.

The vertical registration member increases a rate of increase in transport force generated for the sheets by the vertical registration member, in conjunction with a rate of increase in transport resistance generated for the sheets by the sheet pressing member with an increase in number of the sheets stacked on the processing tray.

This image forming system includes an image forming apparatus, and a sheet postprocessing apparatus for performing postprocessing on a sheet on which an image has been formed by the image forming apparatus. The sheet postprocessing apparatus is the sheet postprocessing apparatus described above.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention are described with reference to the drawings. However, the scope of the invention is not limited to the disclosed embodiments.

A sheet postprocessing apparatus and an image forming system of each embodiment will hereinafter be described with reference to the drawings. It is to be noted that any reference to the number, amount or the like in each embodiment described below is not necessarily intended to limit the scope of the present invention to that number, amount or the like, unless otherwise specified. The same/corresponding components are denoted by the same reference numbers, and redundant description thereof may not be repeated. Some parts of the drawings are shown not in accordance with the ratio of the actual dimensions but with the ratio being changed to clarify the structure for easier understanding of the structure.

The present embodiment relates to an image forming system 1. This image forming system 1 includes an image forming apparatus 2 based on electrophotography, and a sheet postprocessing apparatus 10 for performing postprocessing on a sheet on which an image has been formed by this image forming apparatus 2. Image forming apparatus 2 may be a color printer, a monochrome printer, or a facsimile Image forming apparatus 2 may be a multi-functional peripheral (MFP) of a monochrome printer, a color printer and a facsimile.

First Embodiment

Figure 1:
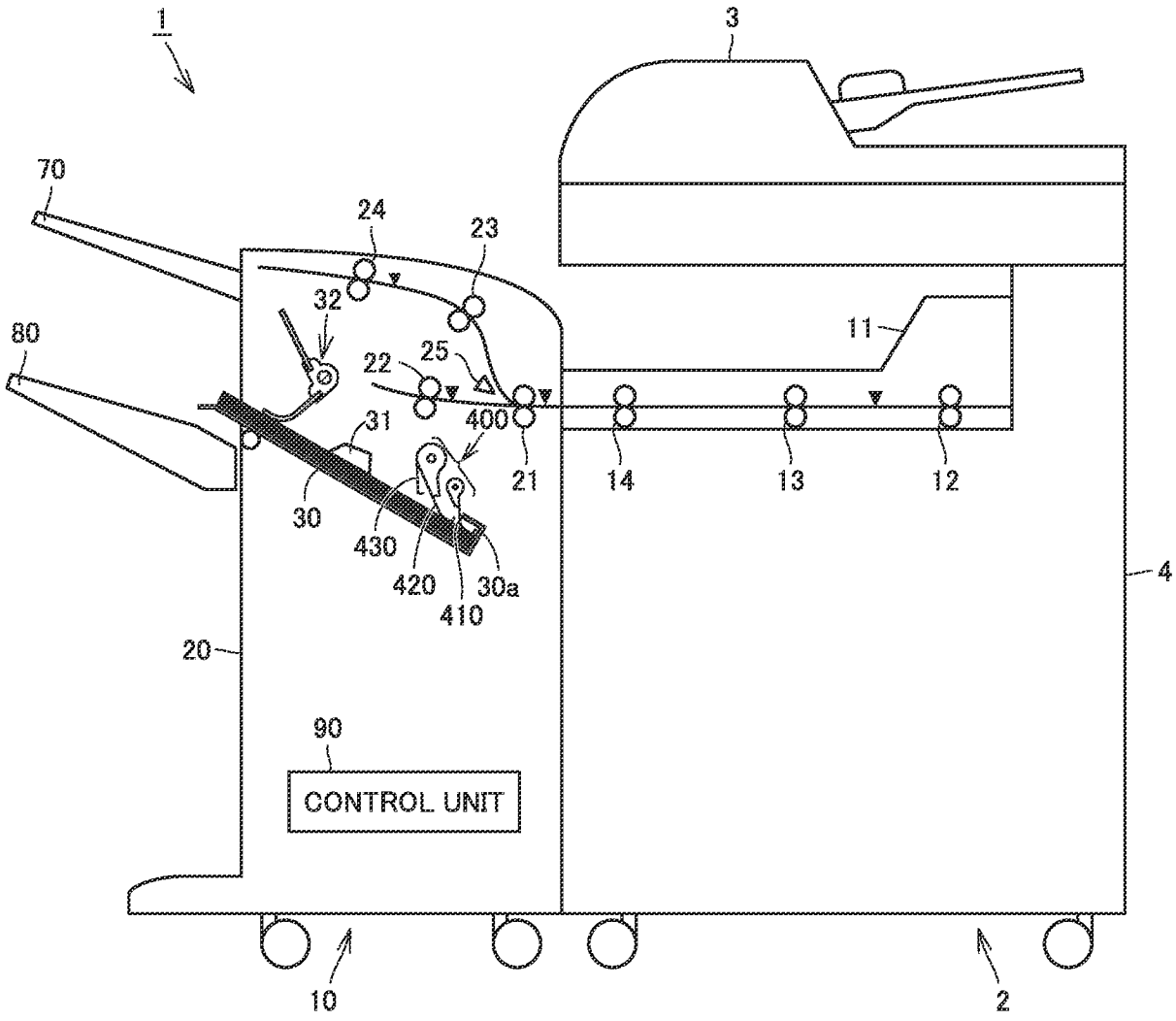
FIG. 1 shows an overall configuration of an image forming system of a first embodiment.

FIG. 1 shows an overall configuration of image forming system 1 of a first embodiment. Image forming system 1 shown in FIG. 1 includes image forming apparatus 2, and sheet postprocessing apparatus 10 for performing postprocessing on a sheet (which corresponds to a recording material) on which an image has been formed by image forming apparatus 2. In the present specification, upward and downward directions as well as rightward and leftward directions are defined with respect to FIG. 1, where the near side with respect to the sheet of drawing of sheet postprocessing apparatus 10 shown in FIG. 1 is referred to as the front, and the far side is referred to as the rear.

Image forming apparatus 2 is, for example, a copier for forming a color image based on an electrophotographic process. Image forming apparatus 2 has a reading unit 3 and a printing unit 4. Reading unit 3 reads an image on a document and supplies the image as image data to printing unit 4. Printing unit 4 has known image forming components such as a photoreceptor, an exposure device, a development unit, and an intermediate transfer belt, and uses these image forming components to form an image on a sheet supplied from an internal paper feed unit.

As the postprocessing, sheet postprocessing apparatus 10 stacks a plurality of sheets on which an image has been formed by image forming apparatus 2, and performs punching, stapling and the like. Sheet postprocessing apparatus 10 includes a transport unit 11, a postprocessing unit 20, a subtray 70, a main tray 80, and a control unit 90.

Transport unit 11 transports a sheet ejected from printing unit 4 further downstream. Transport unit 11 may be provided in image forming apparatus 2. Postprocessing unit 20 performs the postprocessing (punching, stapling and the like). Subtray 70 is a portion to receive a sheet ejected from postprocessing unit 20 without being subjected to the postprocessing. Main tray 80 receives a sheet ejected from postprocessing unit 20 after being subjected to the postprocessing. Control unit 90 is a portion to control sheet postprocessing apparatus 10 as a whole. Control unit 90 is provided in postprocessing unit 20, for example. Control unit 90 may be provided integrally with a control unit of image forming apparatus 2.

Transport unit 11 includes a pair of entrance rollers 12, a pair of intermediate rollers 13, and a pair of exit rollers 14. Entrance rollers 12 receive an image-formed (printed) sheet ejected from printing unit 4. Intermediate rollers 13 transport the sheet downstream. Exit rollers 14 transport the sheet toward postprocessing unit 20.

Postprocessing unit 20 includes a pair of first transport rollers 21, a pair of second transport rollers 22, a pair of third transport rollers 23, and a pair of fourth transport rollers 24. First transport rollers 21 are rollers to receive the sheet transported by transport unit 11. Second transport rollers 22 are rollers to eject the sheet transported from first transport rollers 21 toward a sheet stacker 30 which will be described later. Third transport rollers 23 and fourth transport rollers 24 are rollers to transport the sheet transported from first transport rollers 21 to subtray 70.

Postprocessing unit 20 has a path switching member 25 downstream from first transport rollers 21 and upstream from second transport rollers 22 and third transport rollers 23. Path switching member 25 switches between a path through which the sheet received at first transport rollers 21 is transported to second transport rollers 22, and a path through which the sheet received at first transport rollers 21 is transported to third transport rollers 23.

Postprocessing unit 20 includes sheet stacker 30, a registration plate 31, an accommodation paddle 32, and a sheet pressing member 400. Sheet stacker 30 accommodates a plurality of stacked sheets transported by second transport rollers 22. Sheet stacker 30 functions as a processing tray.

Registration plate 31 registers the plurality of sheets transported to sheet stacker 30 so that they are not misaligned with each other. Accommodation paddle 32 rotates to thereby push the edge of a sheet transported to sheet stacker 30 into an end guide **30*a* of sheet stacker 30. End guide 30*a* plays a role as a sheet stopper. Sheet pressing member 400 includes a first sheet pressing member 410, a second sheet pressing member 420 and a third sheet pressing member 430**.

First sheet pressing member 410, second sheet pressing member 420 and third sheet pressing member 430 come into contact with the sheets stacked on sheet stacker 30 depending on the thickness of the sheets and the width of the sheets (direction perpendicular to the sheet of the drawing of FIG. 1), to press the stacked sheets from the top.

Figure 2:
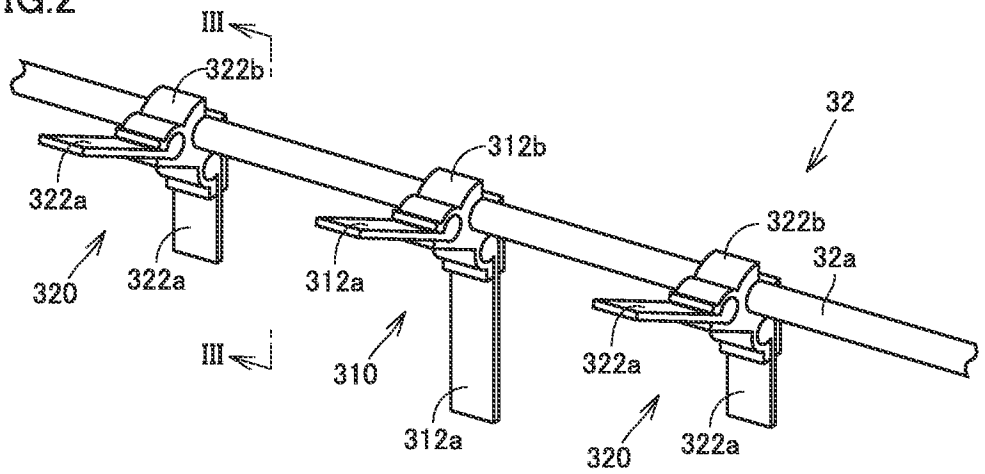
FIG. 2 is a perspective view showing an overall configuration of only an accommodation paddle of related technique.

Referring to FIG. 2, the configuration of accommodation paddle 32 as related technique is described. FIG. 2 is a perspective view showing an overall configuration of only accommodation paddle 32 of related technique. Accommodation paddle 32 functions as a vertical registration device to register (align) the front edge side and the rear edge side in a transport direction (vertical direction) of sheets S1 stacked and arranged on sheet stacker 30.

Accommodation paddle 32 has a rotating shaft 32*a*, a first paddle 310, and second paddles 320 provided on both sides of first paddle 310. First paddle 310 and second paddles 320 are fixed to rotating shaft 32*a*, and rotate around rotating shaft 32*a* along with the rotation of rotating shaft 32*a*.

First paddle 310 has two plate-like paddles 312*a*, which are fixed to a paddle base 312*b*. Paddle base 312*b* is fixed to rotating shaft 32*a*. Paddles 312*a* are formed of an elastic member such as elastically deformable rubber, resin, or elastomer.

Second paddle 320 has the same basic configuration as that of first paddle 310. Second paddle 320 has two plate-like paddles 322*a*, which are fixed to a paddle base 322*b*. Paddle base 322*b* is fixed to rotating shaft 32*a*. Paddles 322*a* are formed of an elastic member such as elastically deformable rubber, resin, or elastomer.

Figure 3:
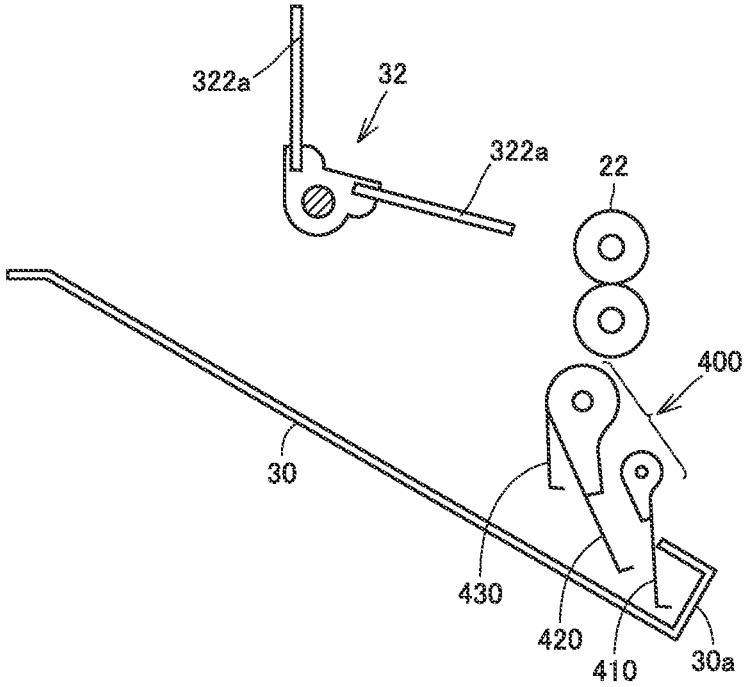
FIG. 3 is a cross-sectional view taken along a line in a direction of arrows in FIG. 2.

Referring to FIG. 3, accommodation paddle 32 and sheet pressing member 400 provided above sheet stacker 30 are described. FIG. 3 is a cross-sectional view taken along a line in a direction of arrows in FIG. 2.

Sheet pressing member 400 is disposed above sheet stacker 30 toward end guide 30*a*. Sheet pressing member 400 has first sheet pressing member 410, second sheet pressing member 420 and third sheet pressing member 430 to press the sheets stacked and arranged on sheet stacker 30 from the top.

Referring to FIGS. 4 to 7, transport of sheets to sheet stacker 30 and a state of sheets stacked on sheet stacker 30 in postprocessing unit 20 of sheet postprocessing apparatus 10 of related technique are described. FIGS. 4 to 7 are first to fourth step diagrams showing states of sheets stacked on sheet stacker 30. FIGS. 4 to 7 are cross-sectional views taken along the line in the direction of arrows in FIG. 2.

Figure 4:
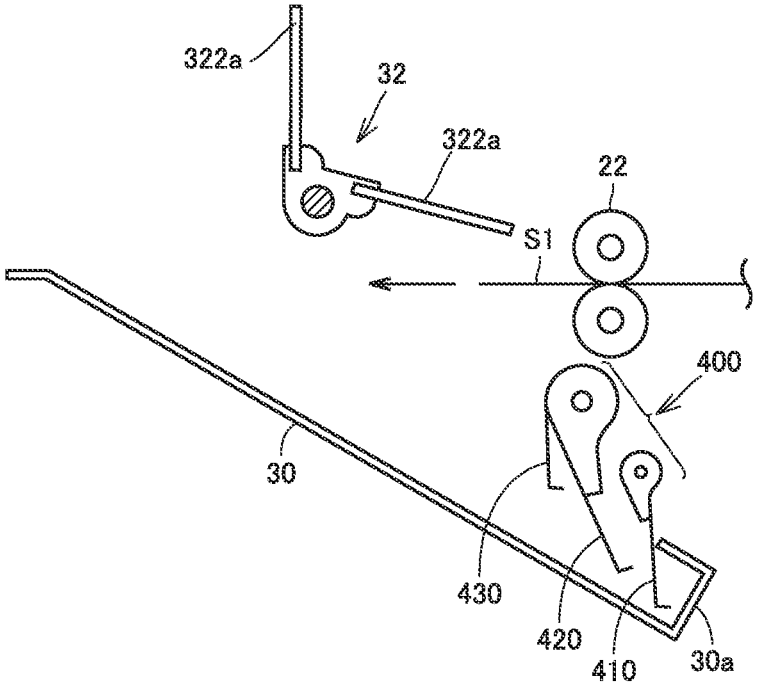
FIG. 4 is a first step diagram showing a state of sheets stacked on a sheet stacker of related technique.
Figure 5:
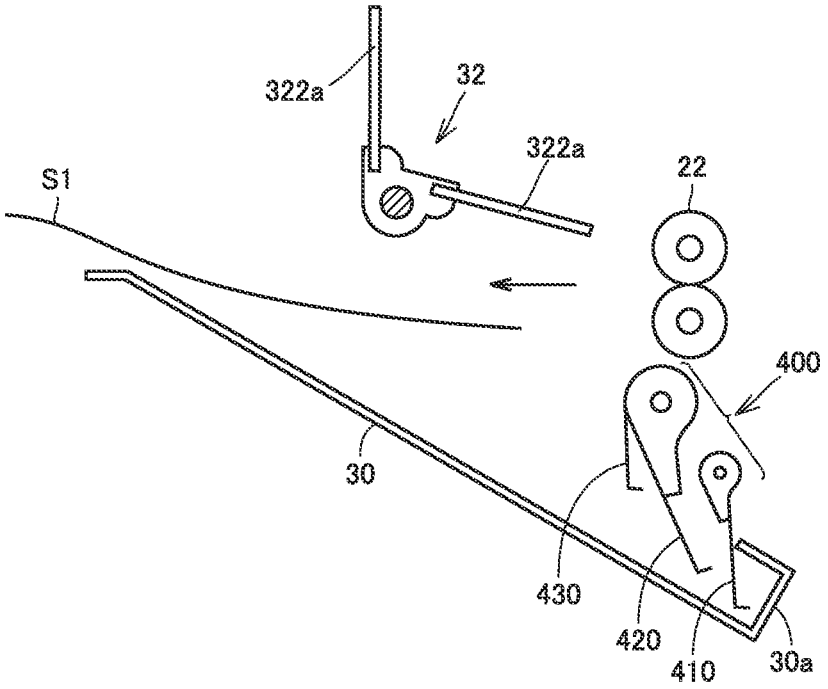
FIG. 5 is a second step diagram showing the state of sheets stacked on the sheet stacker of related technique.
Figure 6:
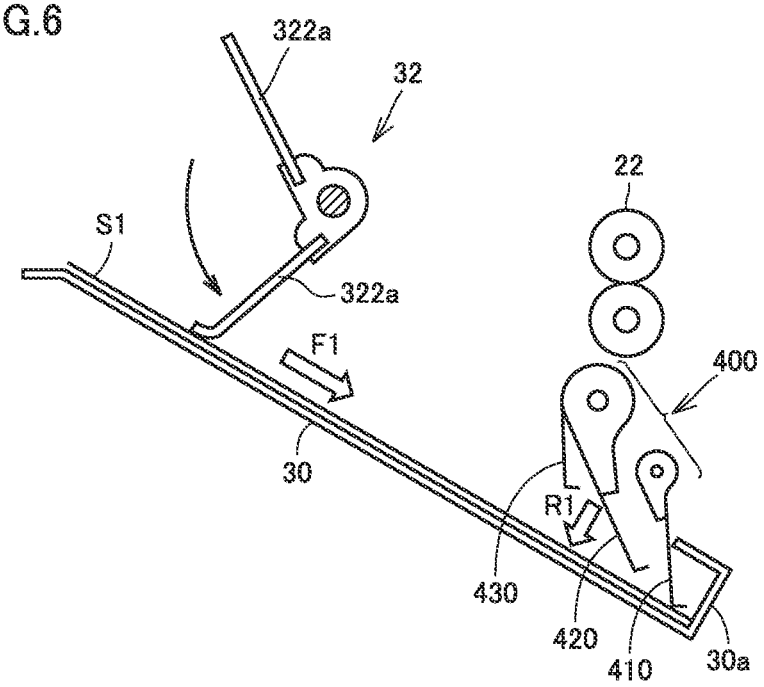
FIG. 6 is a third step diagram showing the state of sheets stacked on the sheet stacker of related technique.

Referring to FIG. 4, sheet S1 on which an image has been formed by image forming apparatus 2 is transported to sheet stacker 30 by second transport rollers 22. Referring to FIG. 5, sheet S1 unloaded by second transport rollers 22 is temporarily ejected leftward. Referring to FIG. 6, accommodation paddle 32 rotates counterclockwise to provide a transport force F1 for transporting sheet S1 toward end guide 30*a* of sheet stacker 30 (direction of an arrow F1 in the figure). A pressing force is provided by sheet pressing member 400 from the top of sheet S1. Sheet S1 is thus stably stacked and arranged on sheet stacker 30. This pressing force serves as transport resistance R1 to sheet S1.

When sheet S1 is subsequently transported to sheet stacker 30 by second transport rollers 22, accommodation paddle 32 rotates counterclockwise to transport sheet S1 toward end guide 30*a* of sheet stacker 30.

Figure 7:
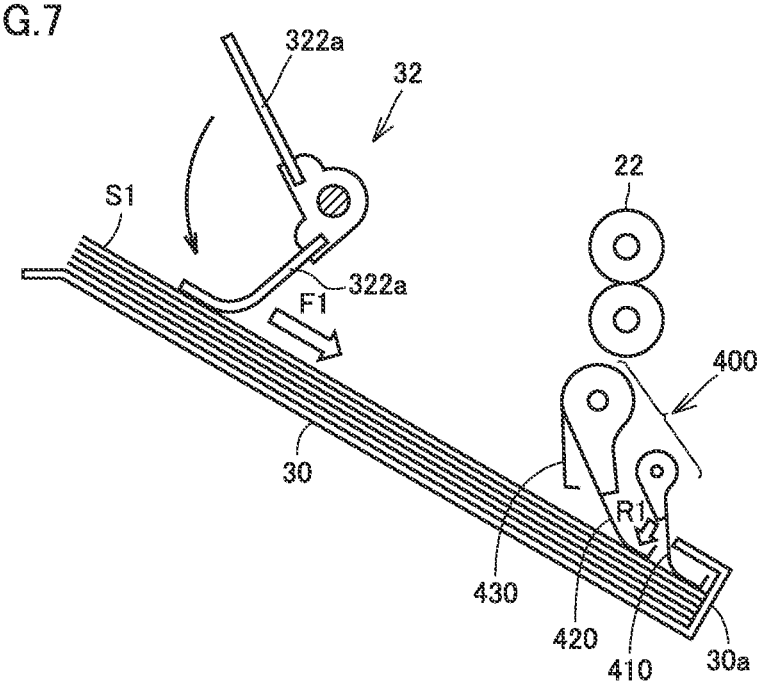
FIG. 7 is a fourth step diagram showing the state of sheets stacked on the sheet stacker of related technique.

As shown in FIG. 7, when the height of sheets stacked and arranged on sheet stacker 30 increases, paddle 322*a* transports sheets S1 toward end guide 30*a* of sheet stacker 30 while being deflected to a greater extent and providing transport force F1 to sheets S1.

In sheet pressing member 400, too, when the height of stacked and arranged sheets S1 reaches a certain level or higher, first sheet pressing member 410, second sheet pressing member 420 and third sheet pressing member 430 provide transport resistance R1 to sheets S1.

Figure 8:
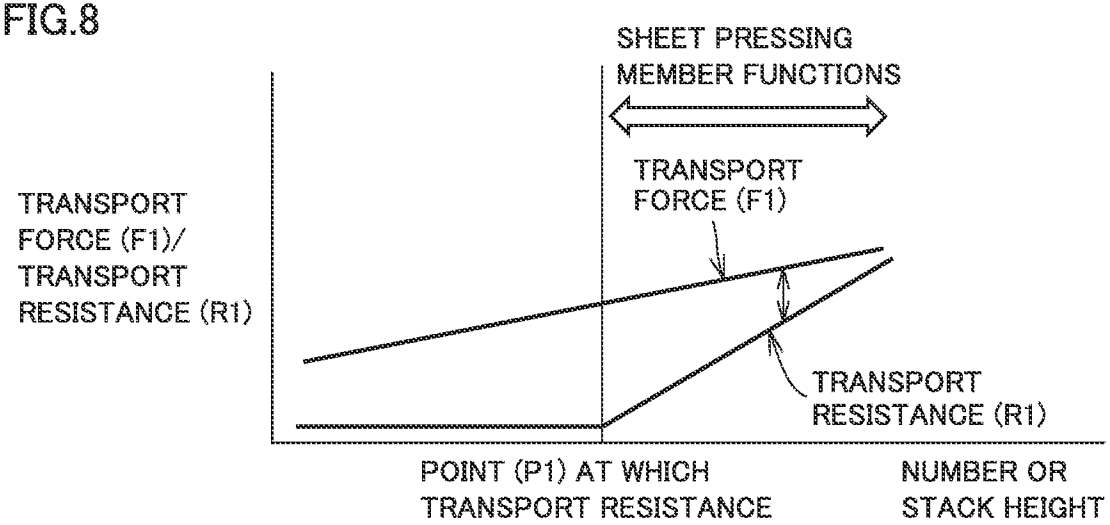
FIG. 8 illustrates relation between a change in transport force to sheets by the accommodation paddle and a change in transport resistance to sheets by a sheet pressing member in related technique.
Figure 9:
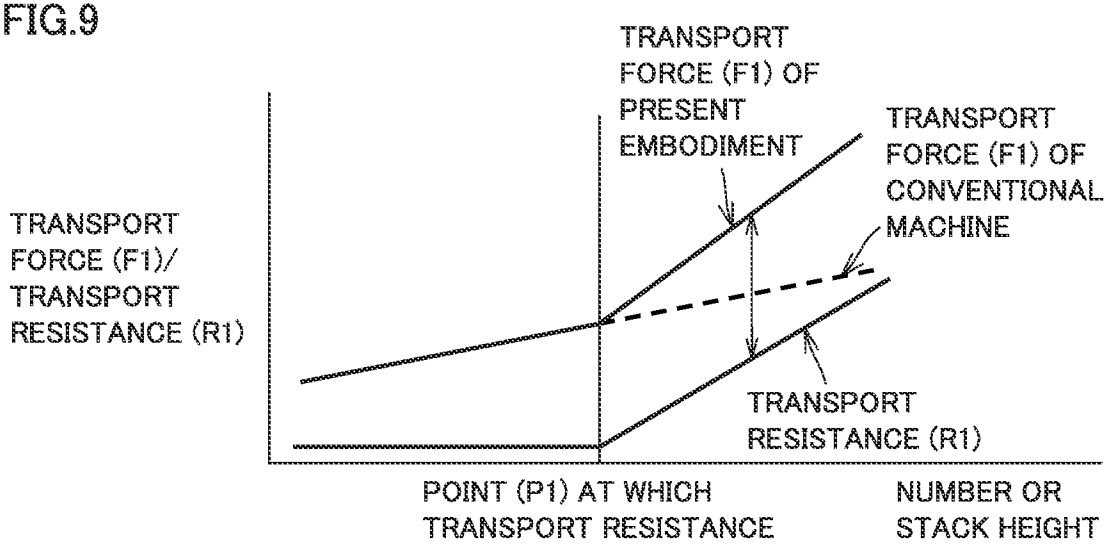
FIG. 9 illustrates relation between a change in transport force to sheets by an accommodation paddle and a change in transport resistance to sheets by a sheet pressing member in the first embodiment.

Referring to FIGS. 8 and 9, relation between a change in transport force F1 to sheets S1 by accommodation paddle 32 and a change in transport resistance R1 to sheets S1 by sheet pressing member 400 is examined.

FIG. 8 illustrates relation between a change in transport force F1 to sheets S1 by accommodation paddle 32 and a change in transport resistance R1 to sheets S1 by sheet pressing member 400 in related technique, and FIG. 9 illustrates relation between a change in transport force F1 to sheets S1 by accommodation paddle 32 and a change in transport resistance R1 to sheets S1 by sheet pressing member 400 in the present embodiment. In both figures, the vertical axis represents a change in transport force F1 and transport resistance R1, and the horizontal axis represents a change in the number or stack height of sheets S1.

As the number or stack height of sheets S1 increases, the deflection of accommodation paddle 32 increases gradually, and therefore transport force F1 also increases gradually. Thus, transport force F1 to sheets S1 by accommodation paddle 32 increases linearly as shown in FIG. 8.

On the other hand, transport resistance R1 to sheets S1 by sheet pressing member 400 does not increase until the stack height of sheets S1 reaches a certain stack number, because sheets S1 start to make contact with sheet pressing member 400 when the stack height of sheets S1 reaches the certain level or higher.

Sheet pressing member 400 presses sheets S1 so that the stack height of sheets S1 is equal to or lower than a predetermined height, and thus needs to increase the pressing force with an increase in the stack number. The elasticity of a film or a spring is generally used for sheet pressing member 400.

After the certain stack number (certain height) has been reached (from point P1 onward), transport resistance R1 increases rapidly in sheet pressing member 400. Since transport resistance R1 has a greater rate of increase (slope of the graph) than transport force F1, the difference between transport force F1 and transport resistance R1 decreases with an increase in the stack number of sheets S1.

When the difference between transport force F1 and transport resistance R1 approaches zero, or when transport resistance R1 exceeds transport force F1, transport force F1 to sheets S1 by accommodation paddle 32 decreases relative to transport resistance R1, resulting in inability to transport sheets S1 toward end guide 30*a* (occurrence of a slip). As a result, a registration failure of sheets S1 occurs on sheet stacker 30.

As shown in FIG. 9, by increasing the rate of increase in transport force F1 generated for sheets S1 by accommodation paddle 32, in conjunction with the rate of increase in transport resistance R1 generated for sheets S1 by sheet pressing member 400 with an increase in the number of sheets S1 stacked on sheet stacker 30, the difference between transport force F1 and transport resistance R1 is prevented from reaching zero, and the occurrence of a slip mentioned above can be avoided.

First Embodiment: Accommodation Paddle 32A

Referring to FIGS. 10 to 14, a sheet postprocessing apparatus and an image forming system of the first embodiment are described. In this first embodiment, the sheet postprocessing apparatus and the image forming system are basically the same as the sheet postprocessing apparatus and the image forming system shown in FIG. 1. The difference lies in the configuration of the accommodation paddle. Thus, the configuration of an accommodation paddle 32A of the first embodiment is described here in detail.

Figure 10:
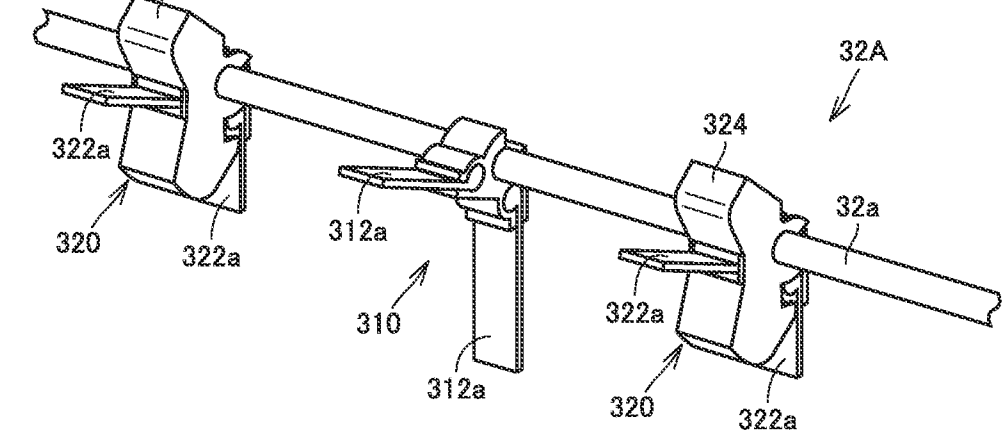
FIG. 10 is a perspective view showing an overall configuration of only an accommodation paddle of the first embodiment.

FIG. 10 is a perspective view showing an overall configuration of only accommodation paddle 32A of the first embodiment. FIGS. 11 to 14 are first to fourth schematic diagrams showing function and effect when using accommodation paddle 32A. FIGS. 11 to 14 are cross-sectional views taken along the line in the direction of arrows in FIG. 2.

Referring to FIG. 10, similarly to the configuration of accommodation paddle 32 described in FIG. 2, accommodation paddle 32A has rotating shaft 32*a*, first paddle 310, and two second paddles 320 provided on both sides of first paddle 310. First paddle 310 and second paddles 320 are fixed to rotating shaft 32*a*, and rotate around rotating shaft 32*a* along with the rotation of rotating shaft 32*a*.

First paddle 310 has two plate-like paddles 312*a*, which are fixed to paddle base 312*b*. Paddle base 312*b* is fixed to rotating shaft 32*a*. Paddles 312*a* are formed of an elastic member such as elastically deformable rubber, resin, or elastomer.

Second paddle 320 has the same basic configuration as that of first paddle 310. Second paddle 320 has two plate-like paddles 322*a*, which are fixed to paddle base 322*b*. Paddle base 322*b* is fixed to rotating shaft 32*a*. Paddles 322*a* are formed of an elastic member such as elastically deformable rubber, resin, or elastomer.

The difference between first paddle 310 and second paddles 320 lies in the lengths of paddle 312*a* and paddle 322*a*. Since first paddle 310 is disposed at the center of sheets S1 to be transported, paddle 312*a* is provided to be longer than paddle 322*a* so as to generate large transport force F1. In each of second paddles 320 disposed on both sides of first paddle 310, on the other hand, paddle 322*a* is provided to be shorter than paddle 312*a* from the viewpoint of preventing the rotation (skew) of sheets S1 to be transported.

Figure 11:
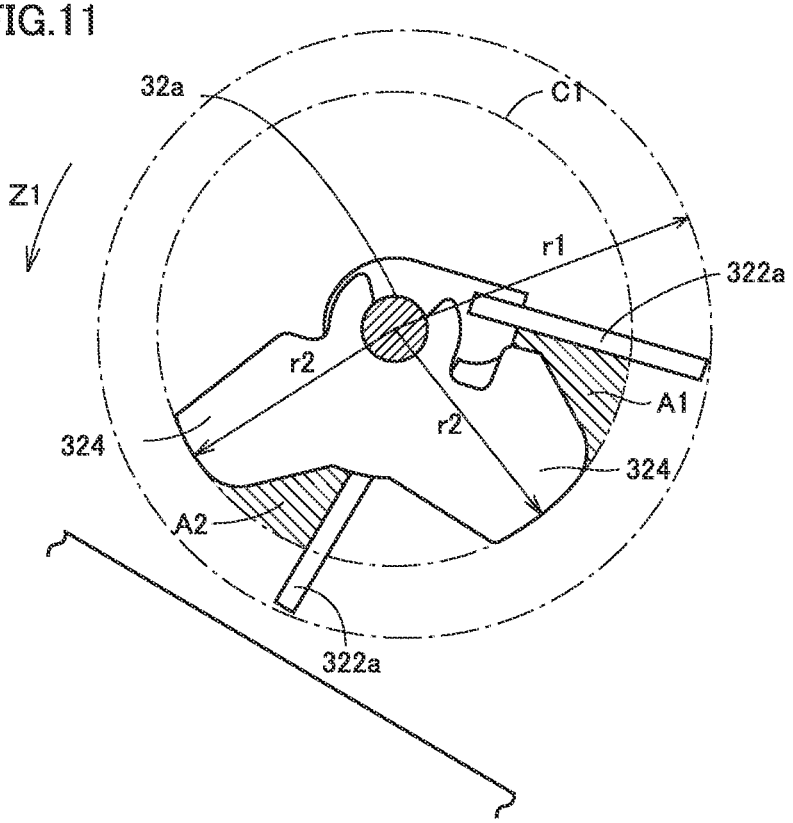
FIG. 11 is a first schematic diagram showing function and effect when using the accommodation paddle of the first embodiment.

Referring to FIGS. 10 and 11, this accommodation paddle 32A is provided with projecting portions 324. Projecting portions 324 are formed of a resin member. Each projecting portion 324 is provided radially with respect to rotating shaft 32*a*, downstream from each paddle 322*a* with respect to a direction of rotation Z1 of rotating shaft 32*a*. Projecting portion 324 has a predetermined thickness in the direction in which rotating shaft 32*a* extends. This thickness is substantially the same in width as paddle 322*a*. Projecting portions 324 are integrally resin-molded so as to be provided downstream from two paddles 322*a*, respectively.

A distance r1 from the edge of paddle 322*a* to the center of rotating shaft 32*a* is longer than a distance r2 from the edge of projecting portion 324 to the center of rotating shaft 32*a*. Projecting portion 324 is disposed at a predetermined distance from paddle 322*a* so as to create a space A1 in which paddle 322*a* formed of an elastic member is deflected toward projecting portion 324.

Referring now to FIGS. 11 to 14, the function and effect of paddle 322*a* of accommodation paddle 32A is described. Referring to FIG. 11, when sheet S1 has not been transported, paddle 322*a* is not in contact with sheet S1, and thus is not deflected downstream in direction of rotation Z1.

Figure 12:
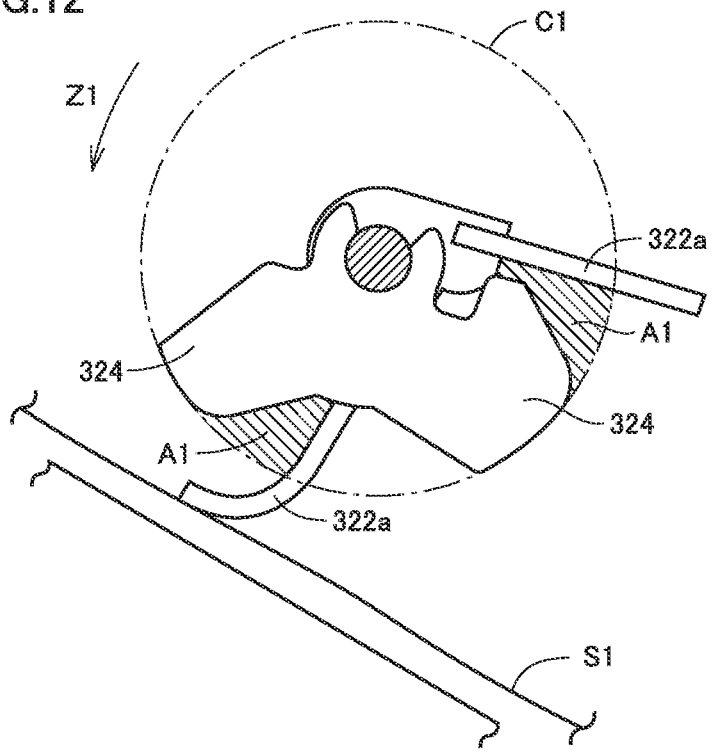
FIG. 12 is a second schematic diagram showing function and effect when using the accommodation paddle of the first embodiment.

Referring to FIG. 12, when sheet S1 is transported and paddle 322*a* comes into contact with sheet S1, the edge side of paddle 322*a* is deflected downstream in direction of rotation Z1. At this time, since space A1 is provided between paddle 322*a* and projecting portion 324 on the downstream side as seen from paddle 322*a*, paddle 322*a* is freely deflected downstream, to thereby generate transport force F1 for transporting sheet S1.

Figure 13:
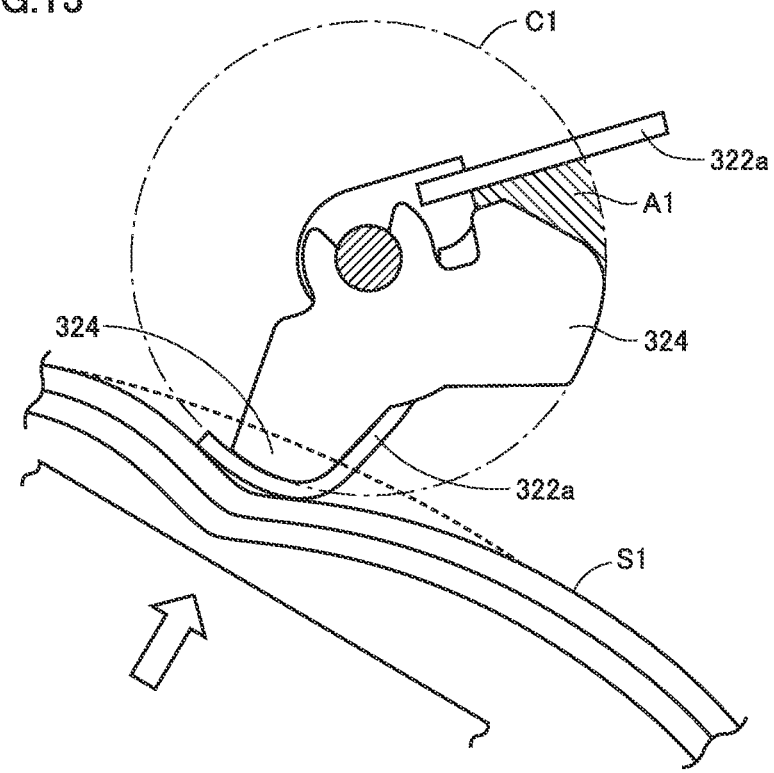
FIG. 13 is a third schematic diagram showing function and effect when using the accommodation paddle of the first embodiment.

Referring to FIG. 13, when the amount of sheets S1 stacked on sheet stacker 30 increases, the stack height of a bundle of sheets S1 increases. The stack height of the bundle of sheets S1 also increases by sheets S1 being curved upward by heat and the like. In this case, paddle 322*a* can no longer be deflected, and instead starts to wrap around projecting portion 324. As a result, sheets S1 are placed in the same state as under a normal rubber roller, in which transport force F1 is provided to sheets S1 based on a repulsive force of sheets S1 while sheets S1 are pressed down by a pseudo-roller.

Figure 14:
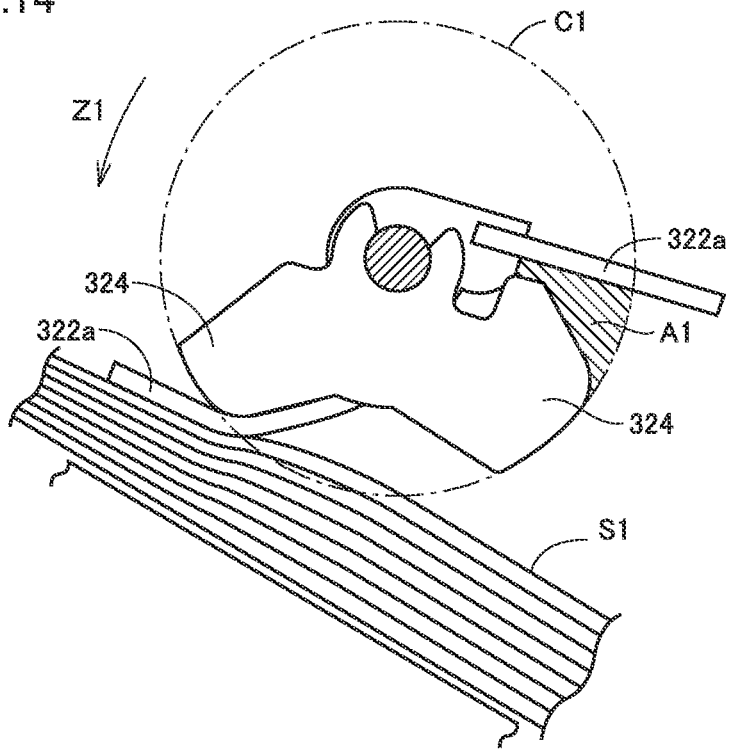
FIG. 14 is a fourth schematic diagram showing function and effect when using the accommodation paddle of the first embodiment.

Referring to FIG. 14, when the amount of sheets S1 stacked on sheet stacker 30 increases further, projecting portion 324 comes into contact with sheets S1 at an early stage, causing paddle 322*a* to wrap around projecting portion 324 along the surface of projecting portion 324. As a result, higher transport force F1 is provided to sheets S1.

When using accommodation paddle 32A of the present embodiment in this manner, by increasing the rate of increase in transport force F1 generated for sheets S1 by accommodation paddle 32A, in conjunction with the rate of increase in transport resistance R1 generated for sheets S1 by sheet pressing member 400 with an increase in the number of sheets S1 stacked on sheet stacker 30, as shown in FIG. 9, the difference between transport force F1 and transport resistance R1 is prevented from reaching zero, and the occurrence of a slip mentioned above can be avoided.

In particular, by causing projecting portion 324 to come into contact with sheets S1 at a point P1 at which transport resistance R1 increases sharply (point at which sheet pressing member 400 starts functioning), transport force F1 can also be increased from point P1 at the same rate of increase as transport resistance R1.

In the present embodiment, two paddles 322*a* are provided, the same number of projecting portions 324 as the number of paddles 322*a* is provided, and the distances from the edges of projecting portions 324 to the center of rotating shaft 32*a* are all equal. As a result, a contour formed by the edges of projecting portions 324 when paddles 322*a* have wrapped around projecting portions 324 has a coaxial circumference. Thus, the pseudo-roller can have a uniform outer diameter, to attain a uniform transport force.

Moreover, when sheet S1 passes through a fixing device in image forming apparatus 2, sheet S1 expands upward when stacked on sheet stacker 30 due to curling that occurs in the sheet or the physical properties such as rigidity of the sheet. This expansion is flattened by projecting portion 324, to generate a repulsive force of sheet S1 (force to return to the original state). Transport force F1 is generated also by this repulsive force. To reliably flatten the expansion of curled sheet S1, therefore, projecting portion 324 should be made of a hard material such as resin.

Second Embodiment: Accommodation Paddle 32B

Figure 15:
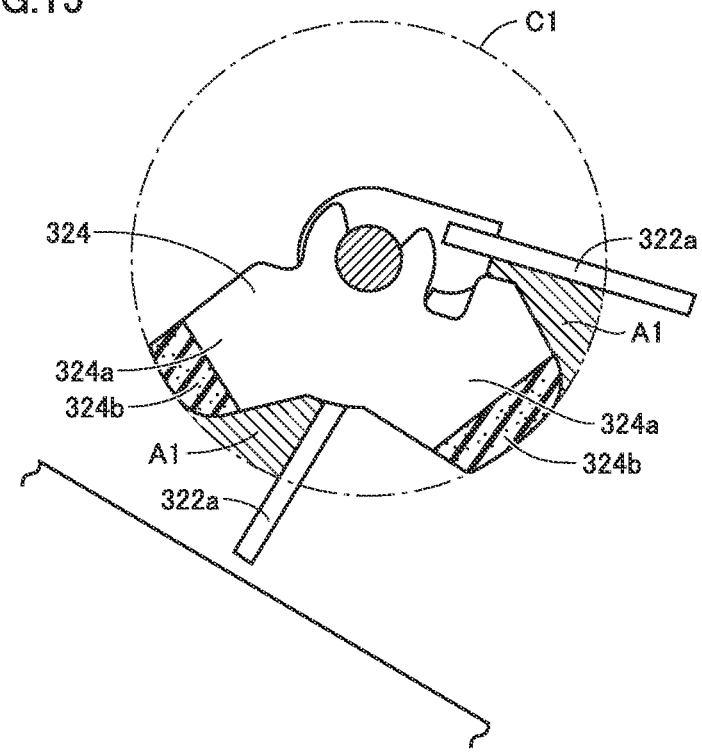
FIG. 15 is a cross-sectional view showing the configuration of only an accommodation paddle of a second embodiment.
Figure 16:
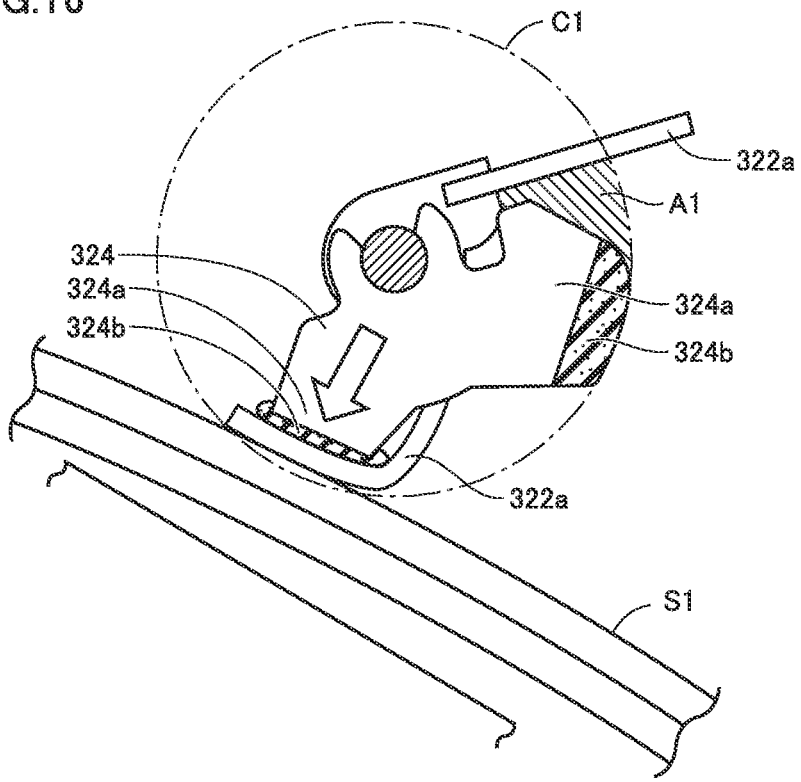
FIG. 16 is a schematic diagram showing function and effect when using the accommodation paddle of the second embodiment.

An accommodation paddle 32B of the present embodiment is described with reference to FIGS. 15 and 16. FIG. 15 is a cross-sectional view showing the configuration of only accommodation paddle 32B of a second embodiment, and FIG. 16 is a schematic diagram showing function and effect when using accommodation paddle 32B. FIGS. 15 and 16 are cross-sectional views taken along the line in the direction of arrows in FIG. 2.

The sheet postprocessing apparatus and the image forming system have the same basic configuration as that of the first embodiment. The difference lies in the form of the accommodation paddle. In particular, the structure of the projecting portion employed for the accommodation paddle is different from the form of the accommodation paddle of the first embodiment.

Referring to FIG. 15, each projecting portion 324 of accommodation paddle 32B of the present embodiment has a highly rigid base portion 324*a* made of resin, and an elastically deformable portion 324*b* provided on the edge side of this base portion 324*a* and elastically deformed by contact with sheet S1. Elastically deformable portion 324*b* is made of a soft material such as sponge.

According to projecting portion 324 of accommodation paddle 32B of the present embodiment, paddle 322*a* wraps around projecting portion 324 in the same manner as the first embodiment even for a higher number of stacked sheets S1, as shown in FIG. 16. However, while transport force F1 is generated mainly by flattening the expansion of sheets S1 in the first embodiment (see FIG. 13), a repulsive force is generated by flattening elastically deformable portion 324*b*, and this repulsive force is used to generate transport force F1 in the present embodiment.

Third Embodiment: Arrangement of Second Paddles 320

Figure 17:
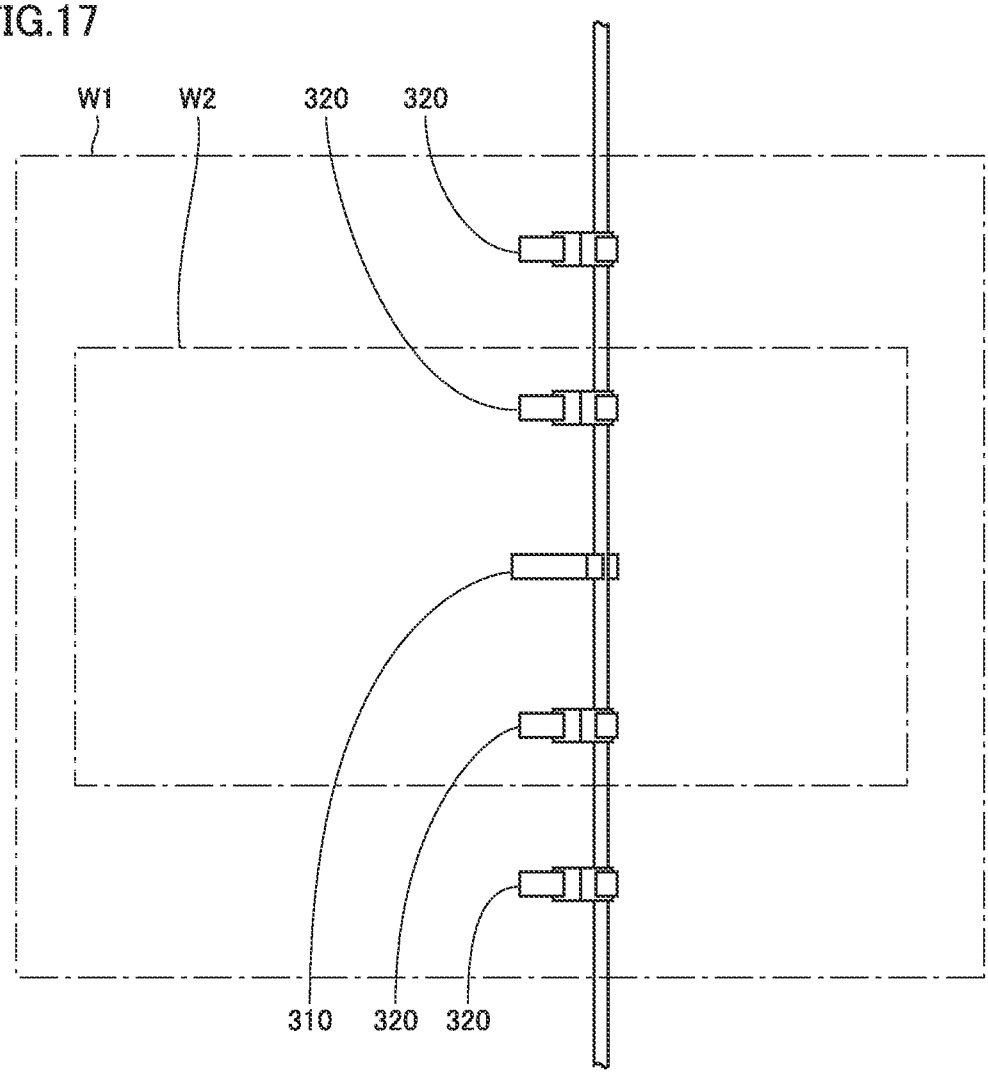
FIG. 17 shows an accommodation paddle of a third embodiment in a plan view.

Referring to FIG. 17, a sheet postprocessing apparatus and an image forming system of a third embodiment are described. This third embodiment is characterized by the arrangement of second paddles 320, and is otherwise the same in configuration as the embodiments described above. FIG. 17 shows accommodation paddle 32 in a plan view.

In the embodiments described above, one second paddle 320 is provided on both sides of first paddle 310, at a total of two locations. In the present embodiment, two second paddles 320 are provided on both sides of first paddle 310, at a total of four locations.

Wide sheet S1 (sheet indicated by W1 in FIG. 17) is usually in contact over a larger width with sheet pressing member 400 than narrow sheet S1 (sheet indicated by W2 in FIG. 17), and thus has higher transport resistance R1. Thus, transport force F1 also needs to be increased accordingly. As shown in the present embodiment, second paddles 320 are provided at two locations for the narrow sheet and at four locations for the wide sheet to perform their respective functions.

Figure 18:
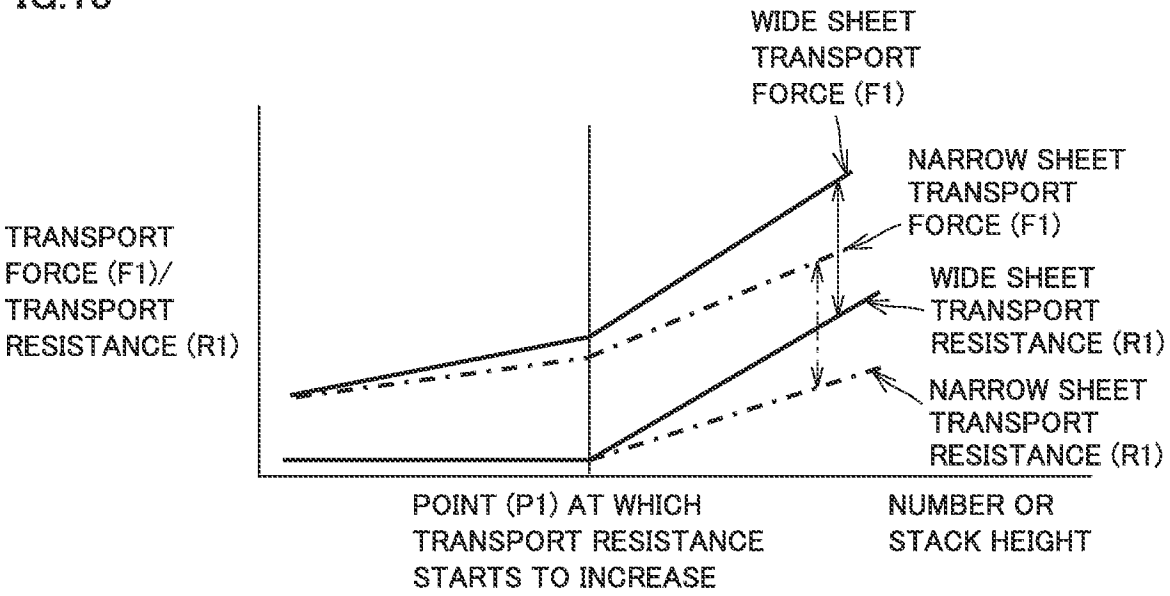
FIG. 18 illustrates relation between a change in transport force to sheets by the accommodation paddle and a change in transport resistance to sheets by a sheet pressing member in the third embodiment.

As a result, transport force F1 can be increased in accordance with the rate of increase in transport resistance R1 as shown in FIG. 18, to thereby optimize the transport of a plurality of types of sheets S1. FIG. 18 illustrates, similarly to FIGS. 8 and 9, relation between a change in transport force to sheets by the accommodation paddle and a change in transport resistance to sheets by the sheet pressing member.

According to the sheet postprocessing apparatus and the image forming system of the present embodiment described above, there can be provided a sheet postprocessing apparatus and an image forming system in which, even when transport resistance increases with an increase in the number of sheets stacked on a processing tray, transport force can be increased accordingly to prevent the occurrence of a registration failure.

The numbers and positions of first paddles 310 and second paddles 320 to be provided are not limited to those in the embodiments described above, but can be modified as appropriate depending on the specifications required of the sheet postprocessing apparatus.

This sheet postprocessing apparatus includes: a processing tray on which sheets are stacked and arranged; a vertical registration member for registering a front edge side and a rear edge side in a transport direction of the sheets stacked and arranged on the processing tray; and a sheet pressing member for pressing the sheets stacked on the processing tray from above.

The vertical registration member increases a rate of increase in transport force generated for the sheets by the vertical registration member, in conjunction with a rate of increase in transport resistance generated for the sheets by the sheet pressing member with an increase in number of the sheets stacked on the processing tray.

In another embodiment, the vertical registration member includes a rotating shaft, a flexible paddle provided radially with respect to the rotating shaft and rotating with the rotating shaft, and a projecting portion provided radially with respect to the rotating shaft, downstream from the paddle with respect to a direction of rotation of the rotating shaft, and rotating with the rotating shaft, a distance from an edge of the paddle to the center of the rotating shaft is longer than a distance from an edge of the projecting portion to the center of the rotating shaft, and the projecting portion is disposed relative to the paddle so as to create a space in which the paddle is deflected toward the projecting portion.

In another embodiment, two or more of the paddles are provided, a same number of the projecting portions as the number of the paddles is provided, and distances from the edges of the projecting portions to the center of the rotating shaft are all equal.

In another embodiment, the projecting portion is rigid.

In another embodiment, at least the edge of the projecting portion is formed of an elastic member.

This image forming system includes an image forming apparatus, and a sheet postprocessing apparatus for performing postprocessing on a sheet on which an image has been formed by the image forming apparatus. The sheet postprocessing apparatus is the sheet postprocessing apparatus described above.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet postprocessing apparatus comprising:

a processing tray on which sheets are stacked and arranged;

a vertical registration member for registering a front edge side and a rear edge side in a transport direction of the sheets stacked and arranged on the processing tray; and a sheet pressing member for pressing the sheets stacked on the processing tray from above, the vertical registration member increasing a rate of increase in transport force generated for the sheets by the vertical registration member, in conjunction with a rate of increase in transport resistance generated for the sheets by the sheet pressing member with an increase in number of the sheets stacked on the processing tray, wherein the vertical registration member includes a rotating shaft, two or more flexible paddles provided radially with respect to the rotating shaft and rotating with the rotating shaft, and a same number of projecting portions provided radially with respect to the rotating shaft, each of the projecting portions is downstream from a respective one of the paddles with respect to a direction of rotation of the rotating shaft, and rotating with the rotating shaft, a distance from an edge of the each of the paddles to the center of the rotating shaft is longer than a distance from an edge of the each of the projecting portions to the center of the rotating shaft, the each of the projecting portions is disposed relative to the each of the paddles so as to create a space in which the each of the paddles is deflected toward the each of the projecting portions, distances from the edges of the projecting portions to the center of the rotating shaft are all equal.

2. The sheet postprocessing apparatus according to claim 1, wherein the projecting portion is rigid.

3. The sheet postprocessing apparatus according to claim 1, wherein at least the edge of the projecting portion is formed of an elastic member.

4. An image forming system comprising:

an image forming apparatus; and a sheet postprocessing apparatus for performing postprocessing on a sheet on which an image has been formed by the image forming apparatus, the sheet postprocessing apparatus being the sheet postprocessing apparatus according to claim 1.

5. A sheet postprocessing apparatus comprising:

a processing tray on which sheets are stacked and arranged;

a vertical registration member for registering a front edge side and a rear edge side in a transport direction of the sheets stacked and arranged on the processing tray; and a sheet pressing member for pressing the sheets stacked on the processing tray from above, the vertical registration member increasing a rate of increase in transport force generated for the sheets by the vertical registration member, in conjunction with a rate of increase in transport resistance generated for the sheets by the sheet pressing member with an increase in number of the sheets stacked on the processing tray, wherein the vertical registration member includes a rotating shaft, a flexible paddle provided radially with respect to the rotating shaft and rotating with the rotating shaft, and a projecting portion provided radially with respect to the rotating shaft, downstream from the paddle with respect to a direction of rotation of the rotating shaft, and rotating with the rotating shaft, a distance from an edge of the paddle to the center of the rotating shaft is longer than a distance from an edge of the projecting portion to the center of the rotating shaft, the projecting portion is disposed relative to the paddle so as to create a space in which the paddle is deflected toward the projecting portion, and at least the edge of the projecting portion is formed of an elastic member.

* * * * *